US005214880A

United States Patent [19]

Woodruff et al.

[11] Patent Number: 5,214,880

[45] Date of Patent: Jun. 1, 1993

[54] DOOR EDGE CONSTRUCTION

[75] Inventors: Alan H. Woodruff, Altoona; Robert C. Tweedt, Ankeny, both of Iowa

[73] Assignee: Emco Enterprises, Inc., Des Moines, Iowa

[21] Appl. No.: 863,013

[22] Filed: Apr. 3, 1992

[51] Int. Cl.[5] ..... E06B 7/16

[52] U.S. Cl. ..... 49/490.1; 49/470; 49/493.1; 49/495.1

[58] Field of Search ..... 49/495, 490, 493, 470, 49/462, 488, 479

[56] References Cited

U.S. PATENT DOCUMENTS

| | | | |
|---|---|---|---|
| 2,107,842 | 2/1938 | Verhagen | 49/488 X |
| 3,024,504 | 3/1962 | Miller | 49/495 X |
| 3,393,471 | 7/1968 | Skowlund et al. | 49/495 X |
| 3,885,351 | 5/1975 | Imperial et al. | 49/470 X |
| 4,403,452 | 9/1983 | Urbanick | 49/488 X |

*Primary Examiner*—Philip C. Kannan
*Attorney, Agent, or Firm*—Zarley, McKee, Thomte, Voorhees & Sease

[57] ABSTRACT

A door edge construction includes a rectangular door having an elongated side extrusion attached to and extending along one edge thereof. A side cap having a C-shaped cross-section is fitted over the side member and over the edges of the door so as to hide them from view. A U-shaped floor sweep is mounted to the bottom edge of the door, and the end of the floor sweep is covered by the lower end of the side cap adjacent the bottom of the door.

10 Claims, 2 Drawing Sheets

DOOR EDGE CONSTRUCTION

BACKGROUND OF INVENTION

This invention relates to a door edge construction.

Many prior art doors, particularly exterior prior art storm doors, include aluminum extrusions extending around the outside edges thereof. These aluminum extrusions are usually attached to the door by means of screws which extend through the extrusions into the edges of the doors.

Many prior art doors of this type leave the screws which attach the extrusions to the door exposed so that they can be seen. This exposure detracts from the aesthetic appearance of the door, and also can result in the screws snagging on clothing or other articles.

Various types of caps or protective covers have been used in the prior art for covering the screws which appear on the edges of the doors. However, one area which is difficult to adequately cover is the juncture between the lower edge of the door and the bottom of the door. Usually the bottom of the door is provided with a U-shaped floor sweep having weather-stripping or the like attached to its bottom edge for engaging the threshold of the door. Prior art capping devices for covering the vertical edges of the door often leave the ends of these door sweeps exposed to view. Also, the U-shaped door sweep often includes a web portion which is spaced downwardly from the bottom edge of the door, thereby exposing an opening which extends along the bottom edge of the door. This opening is usually exposed in prior art devices.

Therefore, a primary object of the present invention is the provision of an improved door edge construction.

A further object of the present invention is the provision of an improved door edge construction which completely covers the screws at the edge of the door and also completely covers the end of the floor sweep thereby covering the opening between the door sweep and the bottom edge of the door from view.

A further object of the present invention is the provision of an improved door edge construction which includes a capping member having fins for providing sealing engagement with a Z-bar mounted to the edge of the door opening.

A further object of the present invention is the provision of an improved door edge construction having a triple sweep fin assembly at the bottom of the door to provide a sealing engagement with the threshold of the door opening.

A further object of the present invention is the provision of an improved door edge construction which is economical to manufacture, durable in use, and attractive in appearance.

SUMMARY OF THE INVENTION

The foregoing objects are achieved by a door edge construction having a U-shaped door sweep mounted on the lower edge of the door. The U-shaped door sweep includes a U-web having two U-legs extending upwardly therefrom and embracing the front and rear surfaces of the door adjacent the bottom edge of the door. The bottom surface of the U-channel is provided with a pair of lips which extend downwardly and inwardly to form a longitudinal channel extending along the length of the U-shaped door sweep. Fitted within this U-shaped channel is the backing member of a fin assembly. The fin assembly includes one or more fins which extend downwardly for engaging the threshold of the door opening to provide a seal between the bottom of the door and the threshold. Various numbers of fins can be used, but the preferred embodiment utilizes three flexible fins.

Extending along the vertical edge of the door is a side member having an H-shaped cross-sectional configuration. The side member includes a central web which is in facing engagement with the vertical edge of the door, and a pair of door engaging flanges which embrace the opposite surfaces of the door adjacent its vertical edge. Extending away from the edge of the door are a pair of curved flanges which are attached to the central web and which extending outwardly therefrom. The side member is attached to the door by a plurality of screws which extend through the central web of the side member into the edge of the door.

A C-shaped cap member is fitted over the side member in protective covering relation thereto. The cap member includes a C-web having a pair of C-flanges extending from the C-web and embracing the front and rear surfaces of the door. The cap member covers both the side member and the vertical edge of the door so as to protect them from view. The screws which attach the side member to the door are also covered by the cap member. Extending along the cap member on the inner edge thereof are a pair of spaced apart sealing fins which are adapted to engage a Z-bar mounted on the vertical edge of the door opening on which the door is mounted. The C-shaped cap member is vertically positioned so that its lower end is in covering relationship over the end of the U-shaped floor sweep mounted at the lower edge of the door. Thus, the lower end of the C-shaped cap member covers the end edges of the floor sweep and also covers the opening of any space left between the bottom edge of the door and the web of the door sweep. This provides a smooth continuous surface along the edge of the door, completely covering the screws, the side member, and the ends of the floor sweep, and creating a pleasing aesthetic appearance. Furthermore, covering all of these edges and rough surfaces minimizes snagging of clothing or other objects which pass through the door.

DESCRIPTION OF THE PREFERRED EMBODIMENT

Figure 7:
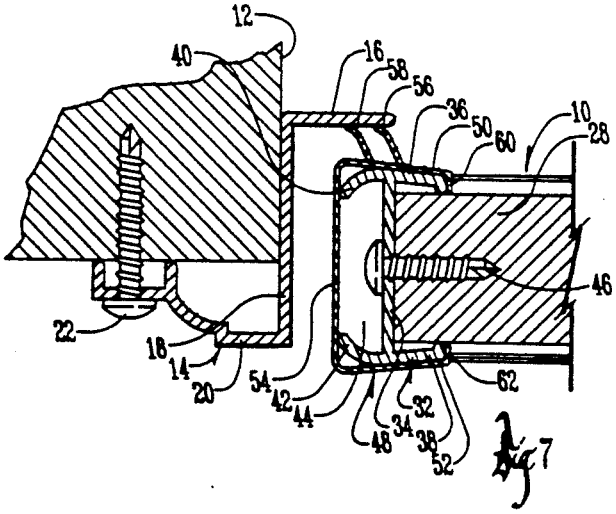
FIG. 7 is a sectional view taken along line 7—7 of FIG. 4.

Referring to the drawings, the numeral 10 generally designates a door mounted in a door opening 12 (FIG. 7). Extending along the vertical edge of door opening 12 is a Z-bar 14 having a first leg 16, a second leg 18, and a front molding 20. A plurality of screws 22 extend through front molding 20 to secure Z-bar 14 to the edge of the door opening.

Door 10 includes a top edge 24, a bottom edge 26 (FIGS. 4–6), and opposite side edges 28, 30. Extending along at least one of the opposite side edges is a side member 32. Side member 32 includes in cross-section a web 34 (FIG. 7), a pair of spaced apart door gripping flanges 36, 38, and a pair of spaced apart channel flanges 40, 42. Channel flanges 40, 42 define a channel 44 therebetween. A plurality of screws 46 extend through the into the edge of the door 10 to secure the side member 32 thereto.

Fitted over and covering side member 32 is an elongated side cap 48 which is comprised of a pair of spaced apart C-flanges 50, 52 joined by a C-web 54. C-flanges 50, 52 embrace the front and rear surfaces of door 10 and the flanges 36, 38 of side member 32 therebetween. Extending along the length of C-flange 50 are a pair of flexible sealing flaps or fins 56, 58 which are adapted to engage leg 16 of Z-bar 14 to provide a seal therebetween. The ends of C-flanges 52, 54 are each provided with an inwardly extending lips 60, 62 which engage the ends of door gripping flanges 36, 38 of side member 32. Side cap 48 includes a lower end 64 which is positioned adjacent the lower edge 26 of the door 10.

Figure 1:
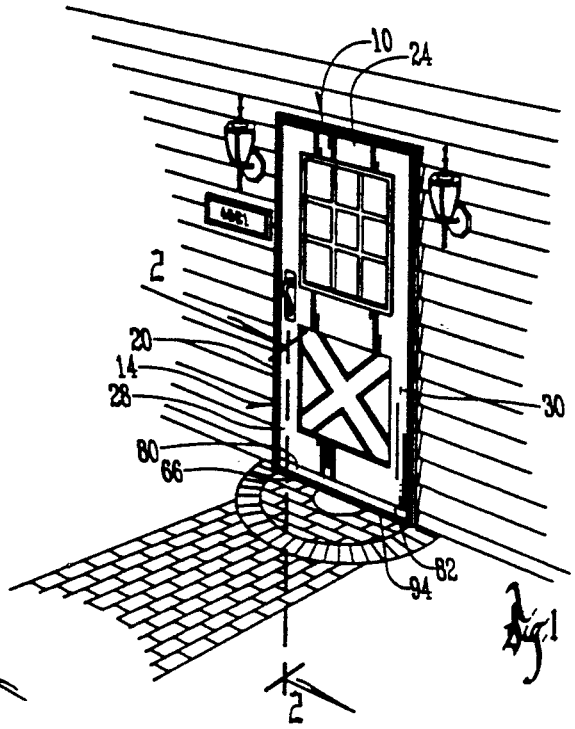
FIG. 1 is a perspective view of a door mounted in the exterior wall of a building.
Figure 6:
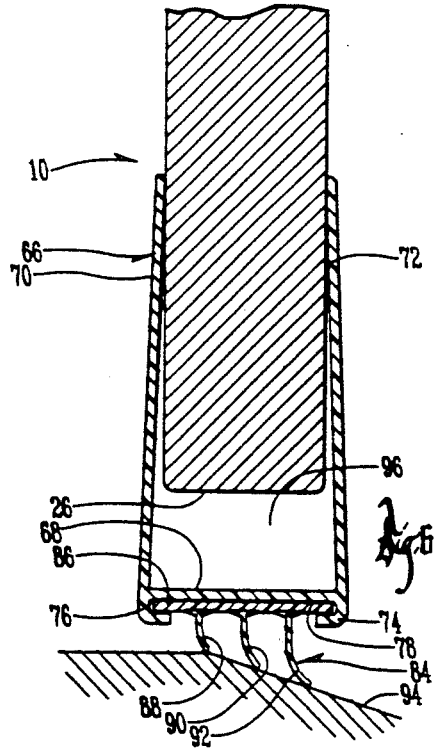
FIG. 6 is a detail sectional view taken along line 6—6 of FIG. 4.

Attached to and extending along the lower edge 26 of door 10 is a U-shaped sweep 66 comprised in cross-section of a U-web 68 and a pair of spaced apart U-legs 70, 72 which embrace the front and rear surfaces of the door 10 therebetween as can be seen in FIG. 6. The U-legs 70, 72 are canted inwardly towards one another so as to provide a tight frictional engagement with the door 10 adjacent bottom edge 26. The U-shaped sweep 66 includes a first end 80 which is positioned adjacent the lower end 64 of side cap 48 and includes a second end 82 (FIG. 1).

Extending downwardly from U-web 68 are a pair of spaced apart lips 74, 76 which form a channel 78 for receiving a fin assembly 84. Fin assembly 84 comprises a rigid backing member 86 which is slidably fitted within the channel 78 formed at the bottom of floor sweep 66. Backing member 86 includes three flexible fins 88, 90, 92 which extend downwardly therefrom for engaging a threshold 94 of the door assembly.

Figure 3:
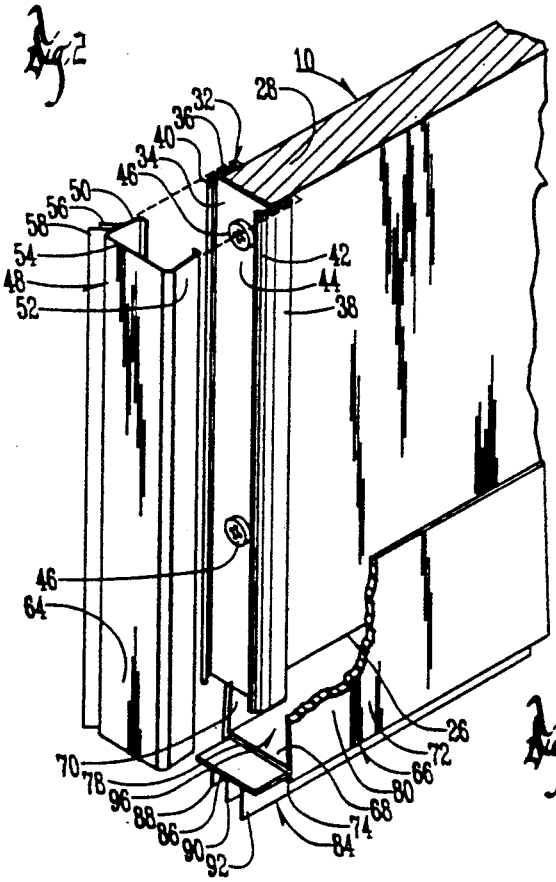
FIG. 3 is a partially exploded view similar to FIG. 2.

As can be seen in FIGS. 3 and 6, an opening or space 96 is provided between the lower edge 26 of door 10 and the U-web 68 of floor sweep 66. The size of this opening 96 will vary as the result of upward and downward adjustment of the door sweep 66 so that the fins 88, 90, 92 will properly engage the threshold 94.

Figure 2:
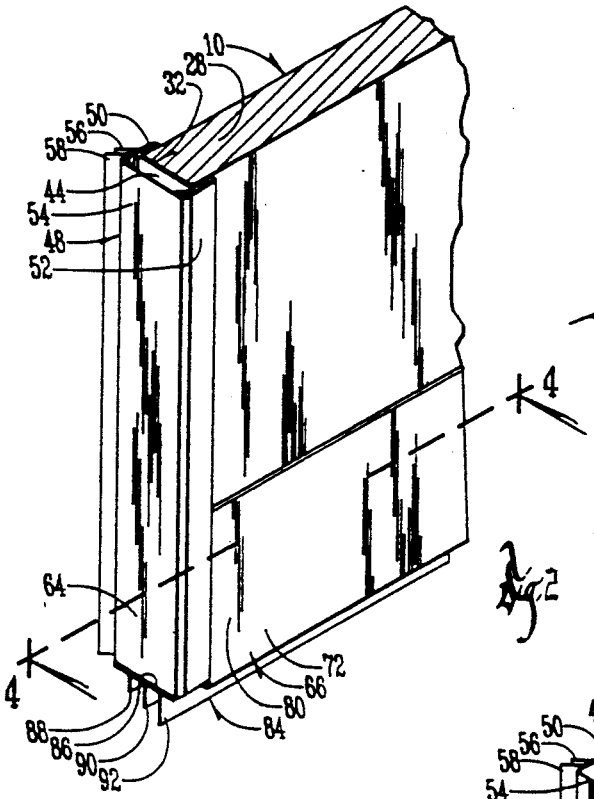
FIG. 2 is an enlarged detail view of the lower end of one edge of the door.
Figure 4:
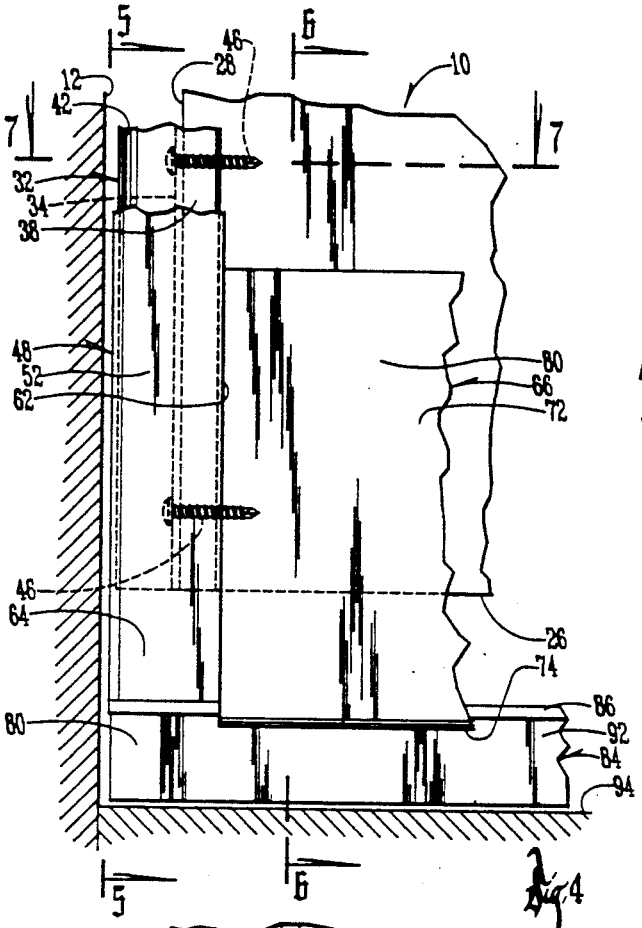
FIG. 4 is a sectional view taken along line 4—4 of FIG. 2.
Figure 5:
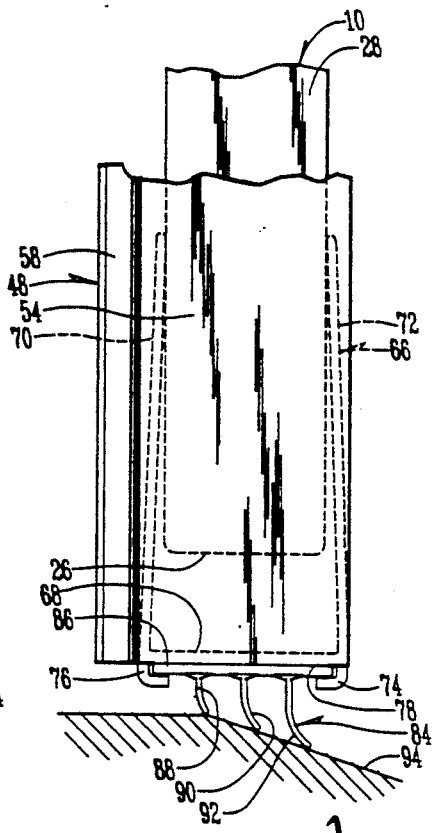
FIG. 5 is an end elevational view taken along line 5—5 of FIG. 4.

After the floor sweep 66 has been mounted to the door, the side cap 48 is positioned downwardly so that its lower end 64 covers the opening 96 and also covers the end edges of the floor sweep 66 in the manner shown in FIGS. 2, 4, and 5. In this position, the C-flanges 50, 52 of side cap 48 embrace the ends of U-legs 70, 72 therebetween as can be seen particularly in FIG. 2. This covers the end edges of the floor sweep 68 which sometimes can be sharp, thereby preventing snagging of the end edges of the floor sweep 66 on clothing or other objects.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

We claim:

1. In combination:

a rectangular door having a front surface, a rear surface, a top edge, a bottom edge, and two opposite side edges;

an elongated cap member having upper and lower ends, said cap member in cross-section having a pair of spaced apart C-flanges interconnected by a C-web to form a C-shaped cross-sectional configuration; said cap member being mounted over one of said side edges of said door with said spaced apart C-flanges embracing said front and rear surfaces of said door therebetween and with said C-web facing said one edge of said door;

an elongated sweep having first and second axial ends and having in cross-section a pair of spaced apart U-flanges interconnected by a U-web to form a U-shaped cross-sectional configuration, said pair of U-flanges embracing said front and rear surfaces of said door therebetween and said U-web having an upwardly presented surface in facing relation to said bottom edge of said door and having a downwardly presented surface;

said sweep having an elongated channel formed therein and facing downwardly from said downwardly presented surface of said U-web;

a fin assembly having an elongated backing member slidably retentively fitted within said channel of said sweep and having fin means extending downwardly from said backing member for engaging a threshold below said door;

said end of said cap member and one of said first and second axial ends of said sweep being adjacent one another, said C-web of said lower end of said cap member being in covering relation over said one axial end of said sweep.

2. A combination according to claim 1 and further comprising an elongated side member having a pair of spaced apart side flanges in facing engagement with said front and rear surfaces of said door and having a web interconnecting said side flanges and being in facing engagement with said one side edge of said door, said C-web and C-flanges of said cap member being in covering relation over said web and pair of side flanges respectively of said elongated side member.

3. A combination according to claim 2 wherein a plurality of screws extend through said web of said side member into said door, said cap member being in covering relation over said screws so as to obscure said screws from view.

4. A combination according to claim 1 wherein one of said C-flanges of said cap member includes at least one flexible weather seal fin protruding outwardly from the outer surface thereof and extending along the length thereof.

5. In combination:

a rectangular door having a front surface, a rear edge, a bottom edge, and first and second opposite side edges;

an elongated sweep operatively attached to said door and extending along the length of said bottom edge of said door, said sweep having a first end adjacent one of said side edges of said door and having a second end adjacent the other of said side edges of said door;

an elongated fin assembly attached to said sweep and extending along the length thereof, said fin assembly having fin means extending downwardly therefrom for brushing engagement with a door threshold below said door, said fin assembly having a first end adjacent said one side edge of said door and having a second end adjacent said other side edge of said door;

an elongated cap member having upper and lower ends and having a C-shaped cross-section comprising a pair of spaced apart C-flanges interconnected by a C-web, said cap member being fitted over said one side edge of said door with said pair of C-flanges embracing said front and rear surfaces of said door and with said C-web in covering relation over said one side edge of said door;

said lower end of said cap member being positioned with said C-web in covering relation over said first end of said sweep.

6. A combination according to claim 5 wherein said lower end of said C-web is in at least partial covering relation over said first end of said fin assembly.

7. A combination according to claim 5 wherein said C-flanges adjacent said lower end of cap member embrace said first end of said sweep therebetween.

8. A combination according to claim 5 wherein an elongated side member is operatively attached to said one side edge of said door, said side member being positioned between said cap member and said one side edge of said door.

9. A combination according to claim 8 wherein screw means extend through said side member into said one side edge of said door for securing said side member to said door, said cap member being in covering relation over said screw means.

10. A combination according to claim 5 wherein said sweep is U-shaped in cross-section and comprises in cross-section a U-web and a pair of spaced apart U-legs extending upwardly from said U-web, said U-legs embracing said front and rear surfaces of said door therebetween.

* * * * *